US006073092A

United States Patent [19]

Kwon

[11] Patent Number: 6,073,092

[45] Date of Patent: Jun. 6, 2000

[54] METHOD FOR SPEECH CODING BASED ON A CODE EXCITED LINEAR PREDICTION (CELP) MODEL

[75] Inventor: Soon Y. Kwon, N. Potomac, Md.

[73] Assignee: Telogy Networks, Inc., Germantown, Md.

[21] Appl. No.: 08/883,019

[22] Filed: Jun. 26, 1997

[51] Int. Cl.[7] ..... G10L 9/14

[52] U.S. Cl. ..... 704/219; 704/223

[58] Field of Search ..... 704/219, 222, 704/221, 220, 223, 262

[56] References Cited

U.S. PATENT DOCUMENTS

| | | | |
|---|---|---|---|
| 5,664,055 | 9/1997 | Kroon | 704/223 |
| 5,717,824 | 2/1998 | Chhatwal | 704/219 |
| 5,787,391 | 7/1998 | Moriya et al. | 704/219 |

*Primary Examiner*—Susan Wieland

[57] ABSTRACT

The invention provides a method for speech coding using Code-Excited Linear Prediction (CELP) producing toll-quality speech at data rates between 4 and 16 Kbit/s. The invention uses a series of baseline, implied and adaptive codebooks, comprised of pulse and random codebooks, with associated gain vectors, to characterize the speech. Improved quantization and search techniques to achieve real-time operation, based on the codebooks and gains, are also provided.

24 Claims, 10 Drawing Sheets

$$P_M(z) = \sum_{k=1}^{M} \alpha_k z^{-k}$$

$$P_M(z) = \sum_{k=1}^{M} \alpha_k z^{-k}$$

METHOD FOR SPEECH CODING BASED ON A CODE EXCITED LINEAR PREDICTION (CELP) MODEL

FIELD OF INVENTION

This invention relates to speech coding, and more particularly to improvements in the field of code-excited linear predictive (CELP) coding of speech signals.

BACKGROUND OF INVENTION

Conventional analog speech processing systems are being replaced by digital signal processing systems. In digital speech processing systems, analog speech signals are sampled, and samples are then encoded by a number of bits depending on the desired signal quality. For a toll-quality speech communication without special processing, the number of bits to represent speech signals are 64 Kbit/s which may be too high for some low rate speech communication systems.

Numerous efforts have been made to reduce the data rates required to encode the speech and obtain a high quality decoded speech at the receiving end of the system. Code-excited linear predictive (CELP) coding techniques, introduced in the article, "Code-Excited Linear Prediction: High-Quality Speech at Very Low Rates," by M. R. Schroeder and B. S. Atal, Proc. ICASSP-85, pages 937–940, 1985, has proven to be the most effective speech coding algorithm for the rates between 4 Kbit/s and 16 Kbit/s.

The CELP coding is a frame based algorithm that stores sampled input speech signals into a block of samples called the "frame" and process this frame of data based on analysis-by-synthesis search procedures for extracting parameters of fixed codebook and adaptive codebook, and linear predictive coding (LPC).

The CELP synthesizer produces synthesized speech by feeding the excitation sources from the fixed codebook and adaptive codebook to the LPC forrnant filter. The parameters of the formant filter are calculated through the linear predictive analysis whose concept is that any speech sample (over a finite interval of frame) can be approximated as a linear combination of past known speech samples. A unique set of predictor coefficients (LPC prediction coefficients) for the input speech can thus be determined by minimizing the sum of the squared differences between the input speech samples and the linearly predicted speech samples. The parameters (codebook index and codebook gain) of the fixed codebook and adaptive codebook are selected by minimizing the perceptually weighted mean squared errors between the input speech samples and the synthesized LPC filter output samples.

Once the speech parameters of fixed codebook, adaptive codebook, and LPC filter are calculated, these parameters are quantized and encoded by the encoder for the transmission to the receiver. The decoder in the receiver generates speech parameters for the CELP synthesizer to produce synthesized speech.

The first speech coding standard based on CELP algorithm is the U.S. Federal Standard FS1016 operating at 4.8 Kbit/s. In 1992, the CCITT (now ITU-T) adopted the low-delay CELP (LD-CELP) algorithm known as G.728. The voice quality of the CELP coder has been improved during the past several years by many researchers. In particular, excitation codebooks have been extensively studied and developed for the CELP coder.

A particular CELP algorithm called vector sum excited linear prediction (VSELP) is developed for North American TDMA digital cellular standard known as IS-54 and described in the article, "Vector Sum Excited Linear Prediction (VSELP) Speech Coding at 8 Kbit/s," by I. R. Gerson and M. Jansiuk, Proc. ICASSP-90, pages 461–464, 1990. The excitation codevectors for the VSELP are derived from two random codebooks to classify the characteristics of the LPC residual signals. Recently an excitation codevector generated from an algebraic codebook is used for the ITU-T 8 Kbit/s speech coding standard in the article, "Draft Recommendation G.729: Coding of Speech at 8 kbit/s using Conjugate-Structure Algebraic-Code-Exited Linear Prediction (CS-ACELP)," ITU-T, COM 15–152, 1995. The addition of the pitch synchronous innovation (PSI) described in the article, "Design of a pitch synchronous innovation CELP coder for mobile communications," by Meno et. al., IEEE J. Sel. Areas Commun., vol. 13, pages 31–41, January 1995, improves the perceptual voice quality. Yet the voice quality of the CELP coder operating between 4 Kbit/s and 16 Kbit/s is not transparent, or toll quality.

Mixed excitation has been applied to the CELP speech coder by Taniguchi et. al. in the article, "Principal Axis Extracting Vector Excitation Coding. High Quality Speech at 8 KB/S," Proc. ICASSP-90, pages 241–244, 1990. Implied pulse codevectors depending on the selected baseline codevectors are introduced to improve the codec performance. Some improvements in terms of subjective measurement and objective measurement are reported. The aforementioned models attempt to enhance the performance of the CELP coder by improving pitch harmonic structures in the synthesized speech. These models depend on the selected baseline codevector which may not be suitable for some female speech, whose residual signal is purely white. Recently, mixed excitations from the baseline codebook and implied codebook have been applied to the CELP model to improve pitch harmonic structures by Kwon et. al. in the article, "A High Quality BI-CELP Speech Coder at 8 Kbit/s and Below," Proc. ICASSP-97, pages 759–762, 1997 and proven the effectiveness of the BI-CELP model. In order to produce a high quality synthesized speech, codebook for the CELP coder is required to characterize the LPC residual spectrums of random noise source and energy concentrated pulse source and mixtures of both random noise source and pulse source because of the characteristics of speech itself and CELP speech coding model.

In addition to the above referenced techniques, various United States Patents address CELP techniques. U.S. Pat. No. 5,526,464, issued to Marmelstein, is directed to reducing the codebook search complexity for CELP. This is accomplished through use of multiple band-passed residual signals with corresponding codebooks, where the codebook size increases as frequency decreases.

U.S. Pat. No. 5,140,638, issued to Moulsley, is directed to a system which uses one-dimensional codebooks as compared to the usual two-dimensional codebooks. This technique is used in order to reduce computational complexity within the CELP.

U.S. Pat. No. 5,265,190, issued to Yip el al., is directed to a reduced computation complexity method for CELP. In particular, convolution and correlation operations used to poll the adaptive codebook vectors in a recursive calculation loop to select the optimal excitation vector from the adaptive codebook are separated in a particular way.

U.S. Pat. No. 5,519,806, issued to Nakamura, is directed to a system for search of codebook in which an excitation source is synthesized through linear coupling of at least two basis vectors. This technique reduces the computational complexity for computing cross correlations.

U.S. Pat. No. 5,485,581, issued to Miyano et al., is directed to a method to reduce computational complexity by correcting an autocorrelation of a synthesis signal synthesized from a codevector of the excitation codebook and the linear predictive parameter using an autocorrelation of a synthesis signal synthesized from a codevector of the adaptive codebook and the linear predictive parameter and a cross-correlation between the synthesis signal of the codevector of the adaptive codebook and the synthesis signal of the codevector of the excitation codebook. The method subsequently searches the gain codebook using the corrected autocorrelation and a cross-correlation between a signal obtained by subtraction of the synthesis signal of the codevector of the adaptive codebook from the input speech signal and the synthesis signal of the codevector of the excitation codebook.

U.S. Pat. No. 5,371,853, issued to Kao et al., is directed to a method for CELP speech encoding with an organized, non-overlapping, algebraic codebook containing a predetermined number of vectors, uniformly distributed over a multi-dimensional sphere to generate a remaining speech residual. Short term speech information, long term speech information, and remaining speech residuals are combined to form a reproduction of the input speech.

U.S. Pat. No. 5,444,816, issued to Adoul et al., is directed to a method to improve the excitation codebook and search procedures of CELP. This is accomplished through use of a sparce algebraic code generator associated to a filter having a transfer function varying in time.

None of the prior art maintains satisfactory or toll-quality speech using a digital coding at low data rates with reduced computational complexity.

SUMMARY OF THE INVENTION

It is therefore, an object of the present invention to provide an enhanced codebook for the CELP coder to produce a high quality synthesized speech at the low data rates below 16 Kbit/s.

It is another object of the present invention to provide an efficient search technique of codebook index for the real-time implementation.

It is another object of the present invention to provide a method of generating vector quantization tables for the codebook gains to produce a high quality speech.

It is another object of the present invention to provide an efficient search method of the codebook gain for the real-time implementation.

These and other objects of the present invention will be apparent to those skilled in the art upon inspection of the following description, drawings, and appended claims.

DETAILED DESCRIPTION OF THE INVENTION

Figure 1:
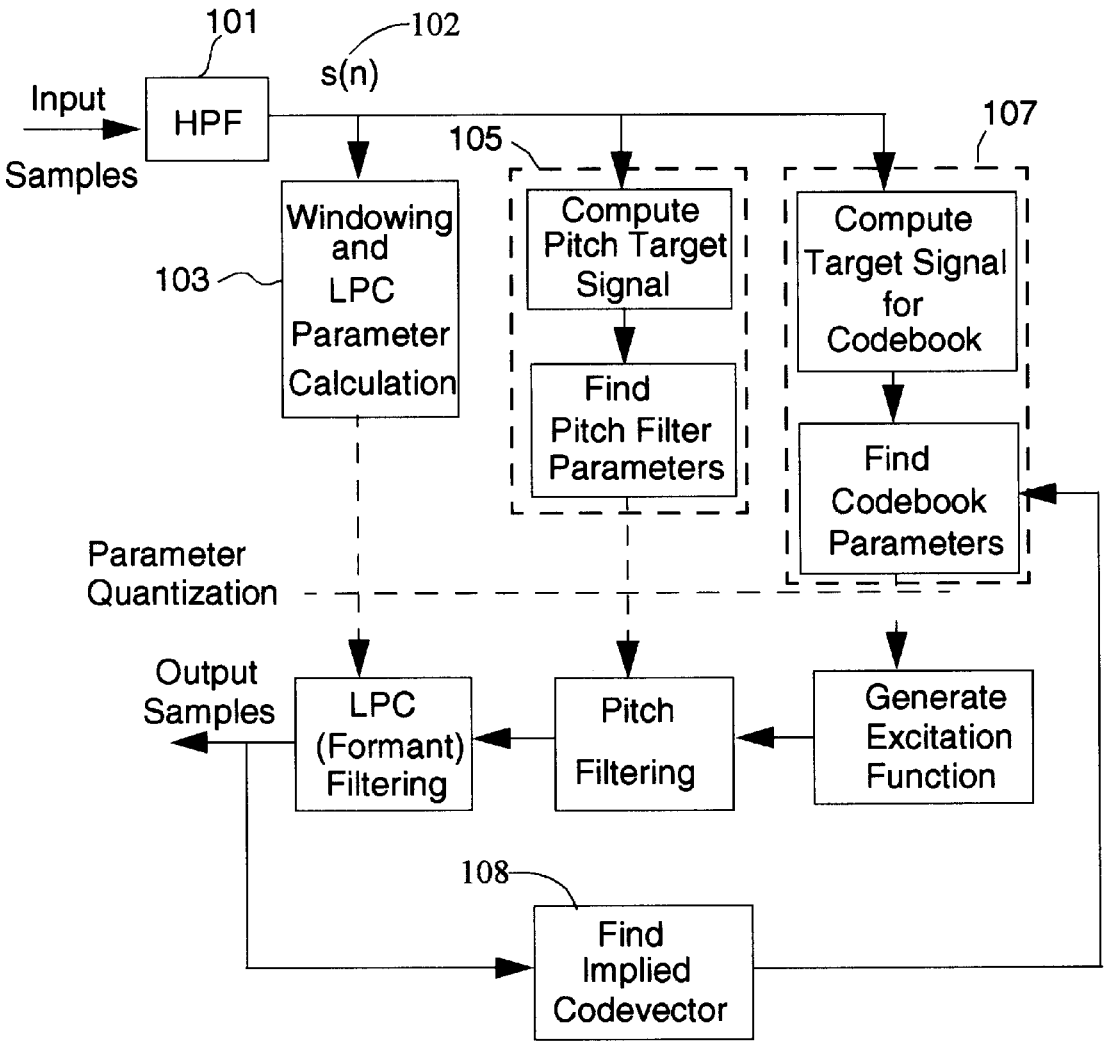
FIG. 1 is a block diagram of the BI-CELP encoder illustrating the three basic operations, LPC analysis, pitch analysis, and codebook excitation analysis including implied codevector analysis.

Definitions: Throughout the specification, description and claims of the present invention, the following terms are defined as follows:

Decoder: A device that translates a digital represented form of finite number into an analog form of finite number.

Encoder: A device that converts an analog form of finite number into a digital form of finite number.

Codec: The combination of an encoder and decoder in series (encoder/decoder)

Codevector: A series of coefficients or a vector that characterize or describe the excitation function of a typical speech segment.

Random Codevector: The elements of the codevector are random variables that may be selected from a set of random sequences or trained from the actual speech samples of a large data base.

Pulse Codevector: The sequence of the codevector elements resembles the shape of a pulse function.

Codebook: A set of codevectors used by the speech codec where one particular codevector is selected and used to excite the filter of the speech codec.

Fixed Codebook: A codebook sometimes called the stochastic codebook or random codebook where the values of the codebook or codevector elements are fixed for a given speech codec.

Adaptive Codebook: The values of the codebook or codevector elements are varying and updated adaptively depending on the parameters of the fixed codebook and the parameters of the pitch filter.

Codebook Index: A pointer, used to designate a particular codevector within a codebook.

Baseline Codebook: A codebook where the codebook index has to be transmitted to the receiver in order to identify the same codevector in the transmitter and receiver.

Implied Codebook: A codebook where the codebook index need not be transmitted to the receiver in order to identify the same codevector in the transmitter and receiver. The codevector index of the implied codebook is calculated by the same method in the transmitter and receiver.

Target signal: The output of the perceptual weighting filter which is going to be approximated by the CELP synthesizer.

Formant: A resonant frequency of the human vocal system causing a prominent peak in the short-term spectrum of speech.

Interpolation: A means of smoothing the transitions of estimated parameters from one set to another.

Quantization: A process that allows one (scalar) or more elements (vector) to be represented at a lower resolution for the purpose of reducing the number of bits or bandwidth.

LSP (Line Spectrum Pair): A representation of the LPC filter coefficients in a pseudo frequency domain which has good properties of quantization and interpolation.

A number of different techniques are disclosed in the specification to accomplish the desired objects of the present invention. These will be described in detail. In one aspect of the invention, a mixed excitation function for the CELP coder is generated from two codebooks, one from the baseline codebook and the other from the implied codebook.

In another aspect of the invention, two implied codevectors, one from the random codebook and the other from the pulse codebook are selected based on the minimum mean squared error (MMSE) between the target signal and weighted synthesized output signals due to the excitation functions from the corresponding implied codebook. The target signal for the implied codevectors is the LPC filter output delayed by the pitch period. Therefore, the implied codevector controls the pitch harmonic structure of the synthesized speech depending on the gain of the implied codevector. This gain is the new mechanism to control the pitch harmonic structure of the synthesized speech regardless of the selected baseline codevector. The selection of implied codevectors using the pitch delayed synthesized speech tends to maintain the pitch harmonics better in the synthesized speech than other CELP coder does. Previous models to enhance the pitch harmonics depend on the baseline codevector which may not be suitable for some female speech whose residual spectrum is purely white.

In another aspect of the invention, the baseline codevectors are selected jointly with the candidate implied codevectors based on the weighted MMSE criterion. For the implied codevector from the pulse codebook the baseline codevector is selected from the random codebook, and for the implied codevector from the random codebook the baseline codebook is selected from the pulse codebook. In this way, excitation functions for the BI-CELP coder always consist of pulse and random codevectors.

In another aspect of the invention, gains for the selected codevectors are vector quantized to improve the coding efficiency while maintaining good performance of the BI-CELP coder. A method to generate vector quantization tables for the codebook gains is described.

In another aspect of the invention, the gain vector and codebook indices are selected by a perceptually weighted minimum mean squared error criterion from all possible baseline indices and gain vectors.

In another aspect of the invention, the codebook parameters are jointly selected for the two consecutive half-subframes to improve the performance of the BI-CELP coder. In this way, the frame boundary problems are greatly reduced without adopting a look-ahead procedure.

In another aspect of the invention, an efficient search method of codebook parameters for real-time implementation is developed to select the near optimum codebook parameters without significant performance degradation.

FIG. 1 shows the BI-CELP encoder in a simplified block diagram. Input speech samples are high-pass filtered by filter 101 in order to remove undesired low-frequency components. These high-pass filtered signals s(n) 102 are divided into frames of speech samples, for example 80, 160, 320 samples per frame. Based on a frame of speech samples, the BI-CELP encoder performs three basic analyses; analysis for LPC filter parameters 103, analysis for pitch filter parameters 105, and analysis for codebook parameters 107 including analysis for implied codevector 108. An individual speech frame is also conveniently divided into subframes. The analysis for the LPC parameters 103 is based on a frame while the analyses for the pitch filter parameters 105 and codebook parameters 107 are based on a subframe.

Figure 2:
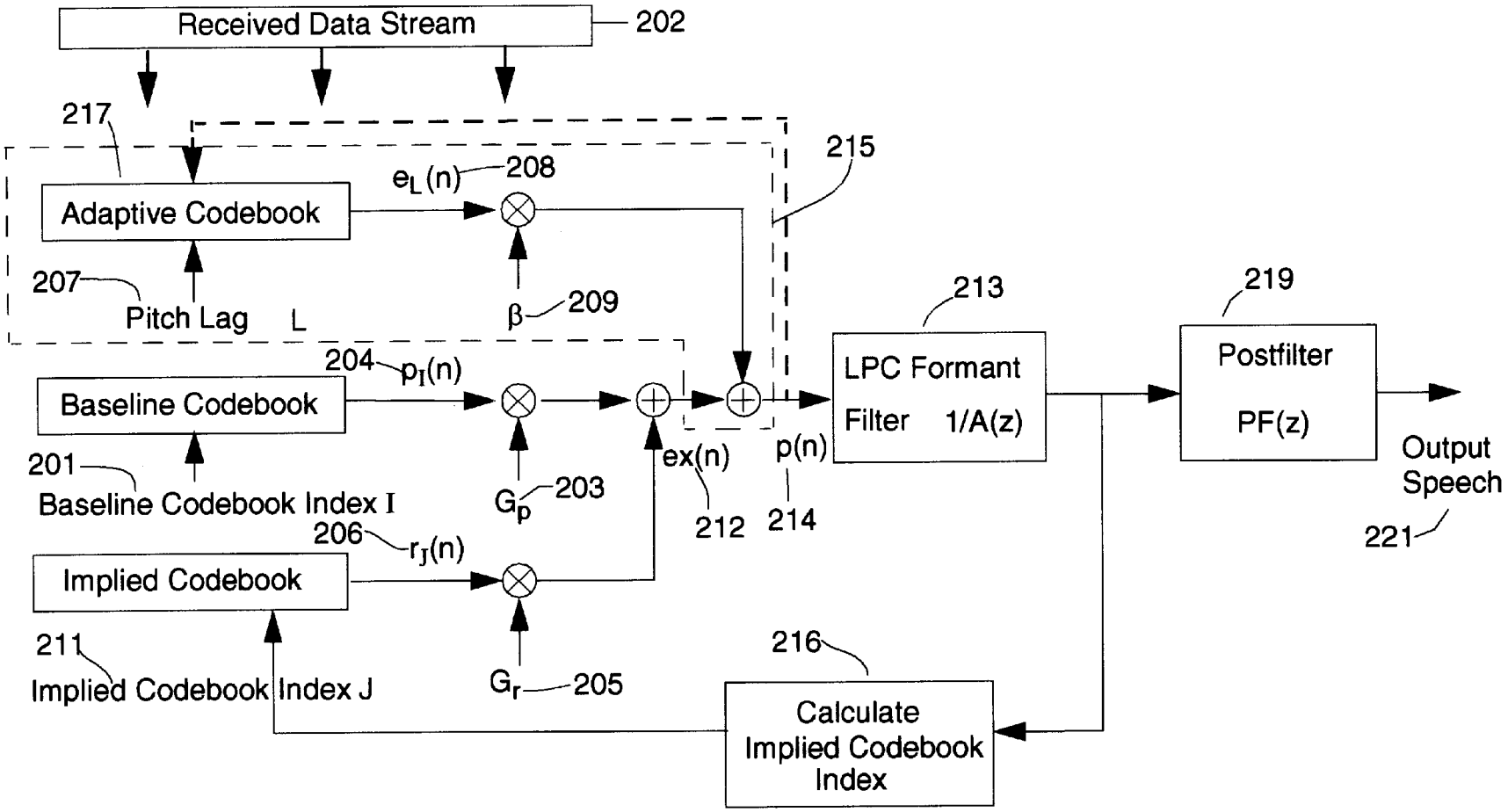
FIG. 2 is a block diagram of the BI-CELP decoder illustrating the four basic operations, generation of the excitation function including implied codevector generation, pitch filtering, LPC filtering, and post filtering.

FIG. 2 shows the BI-CELP decoder of the present invention in a simplified block diagram. The received decoder data stream 202 includes baseline codebook index I 201, gain of the baseline codevector $G_p$ 203, gain of the implied codevector $G_r$ 205, pitch lag L 207, pitch gain β 209, and the LSP transmission code for the LPC formant filter 213 in coded form. The baseline codevector $p_I(n)$ 204 corresponding to a specific subframe is determined from the baseline codebook index I 201 while the implied codevector $r_J(n)$ 206 is determined from the implied codebook index J 211. The implied codebook index J 211 is extracted from the synthesized speech output of the LPC formant filter 1/A(z) 213 and the implied codebook index search scheme 216. The codevector $p_I(n)$ after multiplied by the baseline codebook gain $G_p$ 203 is added to the implied codevector $r_J(n)$ after multiplied by the implied codebook gain $G_r$ 205 to form an excitation source ex(n) 212. The adaptive codevector $e_L(n)$ 208 is determined from the pitch lag L 207 and multiplied by the pitch gain β 209 and added to the excitation source ex(n) 212 to form a pitch filter output p(n) 214. The output p(n) 214 of the pitch filter 215 contributes to the states of the adaptive codebook 217 and is fed to the LPC formant filter 213 whose output is filtered again by the postfilter 219 in order to enhance the perceptual voice quality of the synthesized speech output.

Figure 3:
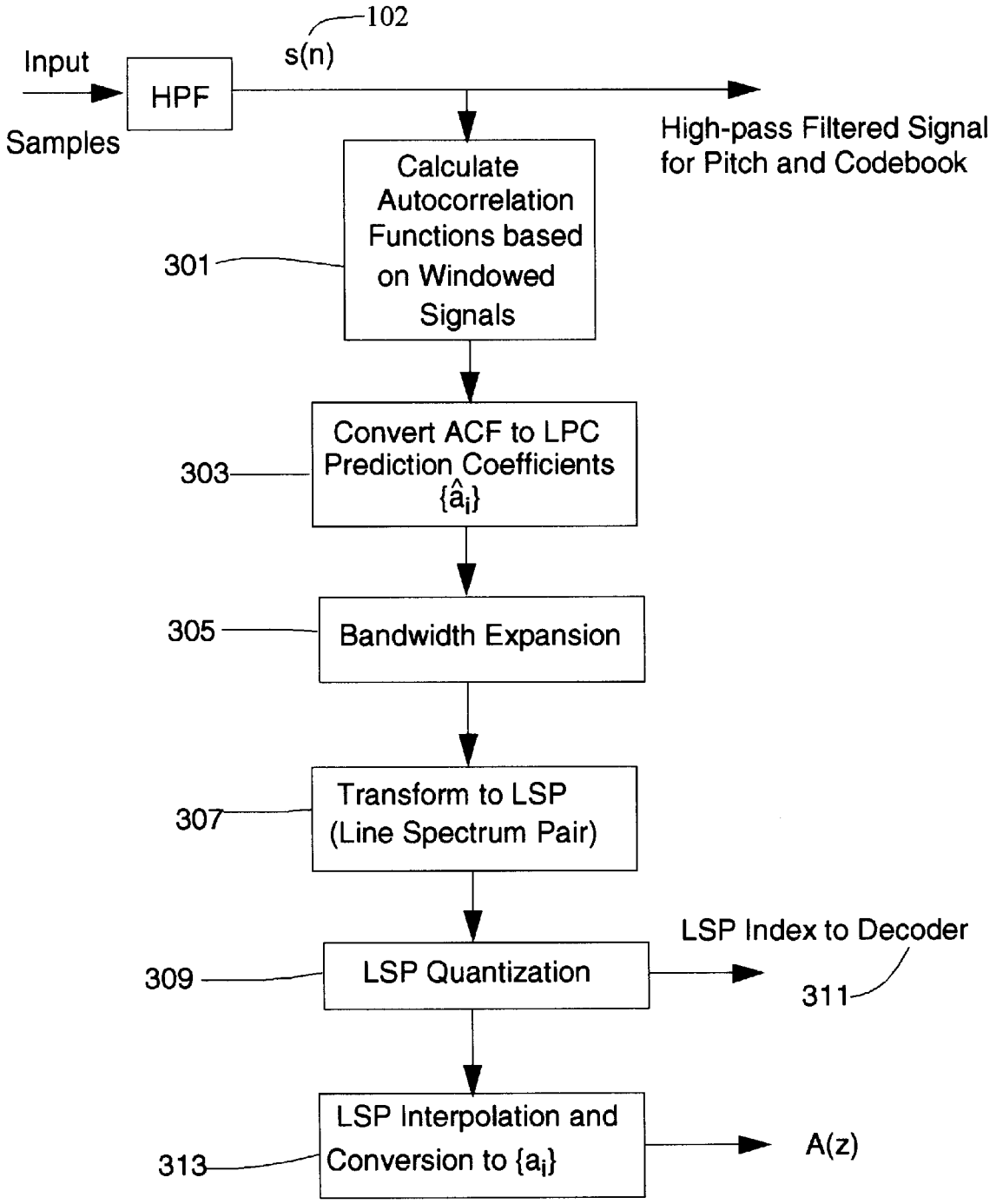
FIG. 3 shows LPC analysis in greater details based on a frame of speech samples.

FIG. 3 shows analysis of LPC parameters, which are illustrated as 103 in FIG. 1, in greater detail based on a frame of speech samples s(n) 102 where the frame length may be 10 ms to 40 ms depending on the applications. Autocorrelation functions 301, typically eleven autocorrelation functions for the LPC filter of ten-th order, are calculated from windowed speech samples where the window functions may be symmetric or asymmetric depending on the applications.

Figure 5:
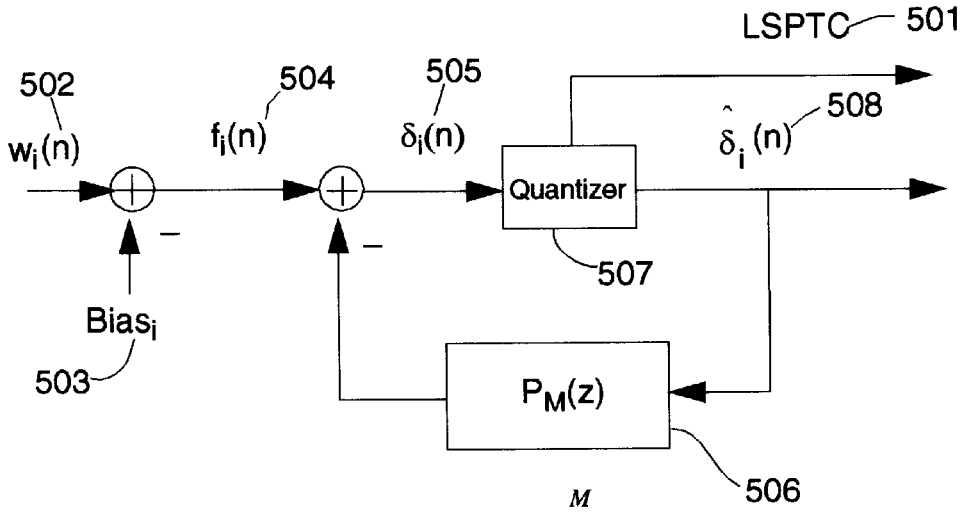
FIG. 5 shows the procedures in details how to quantize LSP residuals by using a moving average prediction technique.

LPC prediction coefficients 303 are calculated from the autocorrelation functions 301 by the recursion algorithm of Durbin which is well known in the literature of speech coding. The resulting LPC prediction coefficients are scaled for bandwidth expansion 305 before they are transformed into LSP frequencies 307. Since the LSP parameters of adjacent frames are highly correlated, high coding efficiency of LSP parameters can be obtained by the moving average prediction, as shown in FIG. 5. The LSP residuals may form split vectors depending on the applications. The LSP indices 311 from the SVQ (split vector quantization) 309 are transmitted to the decoder in order to generate decoded LSP. Finally, the LSPs are interpolated and converted to the LPC prediction coefficients $\{a_i\}$ 313 which will be used for LPC formant filtering and analyses of pitch parameters and codebook parameters.

Figure 4:
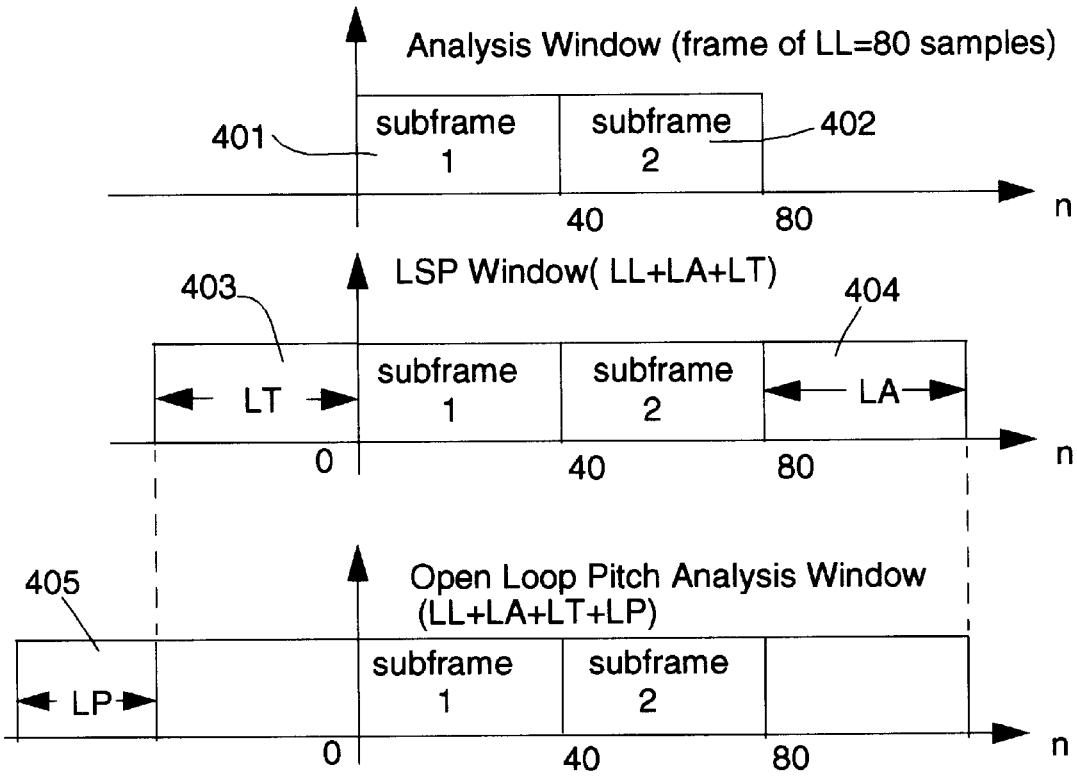
FIG. 4 illustrates the frame structure and window for the BI-CELP analyzer.

FIG. 4 illustrates the frame structures and window for the BI-CELP encoder. Analysis window of LL speech samples consists of first subframe 401 of 40 speech samples and second subframe 402 of 40 speech samples. The parameters of pitch filter and codebook are calculated for each subframes 401 and 402. The LSP parameters are calculated from the LSP window of speech segment 403 of LT speech samples, subframe 401, subframe 402, and speech segment 404 of LA speech samples. The window size LA and LT may be selected depending on the applications. The window sizes for the speech segments 403 and 404 are set to 40 speech samples in the BI-CELP encoder. Open loop pitch is calculated from the open loop pitch analysis window of speech segment 405 of LP speech samples and LSP window. The parameter LP is set to 80 speech samples for the BI-CELP encoder.

FIG. 5 illustrates the procedure used to quantize LSP parameters and to obtain LSP transmission code LSPTC 501. The procedure is as follows:

The ten LSPs $w_i(n)$ 502 are separated into 4 low LSPs and 6 high LSPs, i. e.,($w_1$, $w_2$, $w_3$, $w_4$) and ($w_5$, $w_6$, . . . , $W_{10}$)

Mean value $Bias_i$ 503 is removed to generate zero mean variable $f_i(n)$ 504, i.e., $f_i(n)=w_i(n)-Bias_i$, i=1, . . . , 10.

LSP residual $\delta_i(n)$ 505 is calculated from the MA (Moving Average) predictor 506 and quantizer 507 as $$\delta_i(n) = f_i(n) - \sum_{k=1}^{M} \alpha_k^{(i)} \hat{\delta}_i(n-k) \quad 1 \le i \le 10 \tag{1}$$

$\alpha_k^{(i)}$: Predictor Coefficients
$\hat{\delta}(n)$: Quantized Residuals for frame n
M: Predictor Order (M=4)

The mean values and predictor coefficients may be obtained by the well known vector quantization techniques depending on the applications from the large data base of training speech samples.

The LSP residual vector $\delta_i(n)$ 505 is separated into two vectors as $$\delta_l=(\delta_1, \delta_2, \delta_3, \delta_4) \tag{2}$$

$$\delta_h=(\delta_5, \delta_6, \delta_7, \delta_8, \delta_9, \delta_{10}) \tag{3}$$

A weighted mean squared error (WMSE) distortion criterion is used for the selection of optimum codevector $\hat{x}$, i.e., codevector with minimum WMSE. The WMSE between the input and the quantized vector is defined as $$d(x,\hat{x})=(x-\hat{x})^T W(x-\hat{x}) \tag{4}$$

where W is a diagonal weighting matrix which may be depending on x. The diagonal weight for the i-th LSP parameter is given by $$w_i(x_i) = \left[\frac{1}{x_i - x_{i-1}} + \frac{1}{x_{i+1} - x_i}\right]^2 \tag{5}$$

where $x_i$ is the i-th LSP parameter with $x_0$=0.0 and $x_{11}$=0.5.

The quantization vector tables for $\delta_l$ and $\delta_h$ may be obtained by the well known vector quantization techniques depending on the applications from the large data base of training speech samples.

The index of the optimum codevector $\hat{x}$ in the corresponding vector quantization table is selected as the transmission code LSPTC 501 for the LSP input codevector x. There are two input codevectors for the quantization of LSP parameters and two transmission codes are generated for the decoding of LSP parameters.

Figure 6:
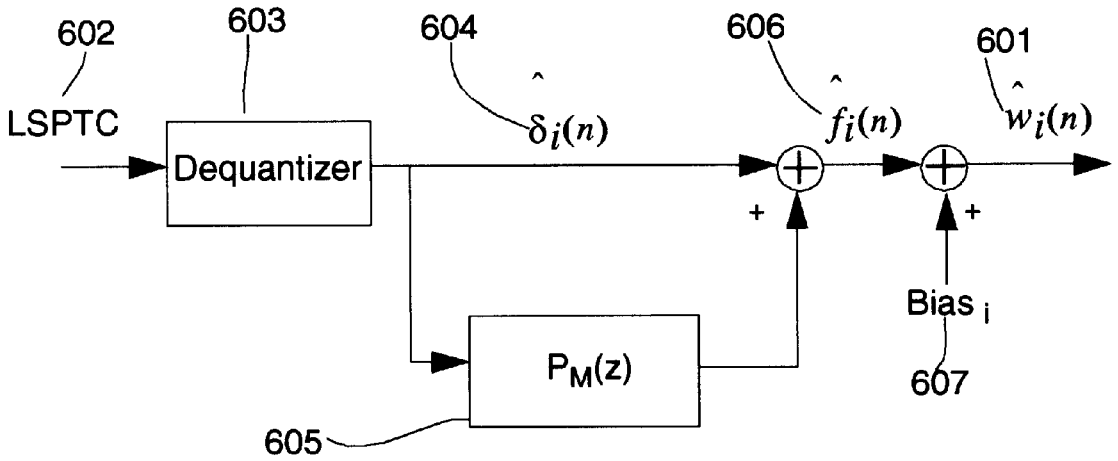
FIG. 6 illustrates the procedure in detail how to decode LSP parameters from the received LSP transmission codes.

The quantizer output δi(n) 508 will be used for the generation of the LSP frequencies 601 in FIG. 6 at the transmitter side.

FIG. 6 illustrates the procedure used to decode LSP parameter $\hat{w}_i(n)$ 601 from the received LSP transmission code LSPTC 602 which will be identical to the LSPTC 501 if there is no bit error introduced in the channel. The procedure is as follows:

Two LSPTCs (one for the low LSP residual and the other for the high LSP residual) are dequantized by the dequantizer 603 to produce LSP residual δi(n) 604 for i=1, . . . , 10.

Zero mean LSP $\hat{f}_i(n)$ 606 are calculated from the dequantized LSP residual δi(n) and predictor 605 as:

$$\hat{f}_i(n) = \hat{\delta}_i(n) + \sum_{k=1}^{M} \alpha_k^{(i)} \hat{\delta}_i(n-k) \quad 1 \le i \le 10 \tag{6}$$

$\alpha_k^{(i)}$: Predictor Coefficients
$\delta_i(n)$: Quantized Residuals at frame n
M: Predictor Order (M=4)

Finally LSP frequencies $\hat{w}_i(n)$ 601 are obtained from zero mean LSP $\hat{f}_i(n)$ 606 and $Bias_i$ 607 as $$\hat{w}_i(n)=\hat{f}_i(n)+Bias_i, \ 1 \le i \le 10 \tag{7}$$

The decoded LSP frequencies ŵi(n) are checked to ensure the stability before converting to LPC prediction coefficients. The stability is guaranteed if the LSP frequencies are ordered properly, i.e., LSP frequencies are increasing with increasing index. If the decoded LSP frequencies are out of order, sorting is executed to guarantee the stability. In addition, the LSP frequencies are forced to be at least 8 Hz apart to prevent large peaks in the LPC formant synthesis filter.

The decoded LSP frequencies ŵi(n) are interpolated and converted to the LPC prediction coefficients $\{]_i\}$ which will be used for the LPC formant filtering and analyses for the pitch parameters and codebook parameters.

Figure 7:
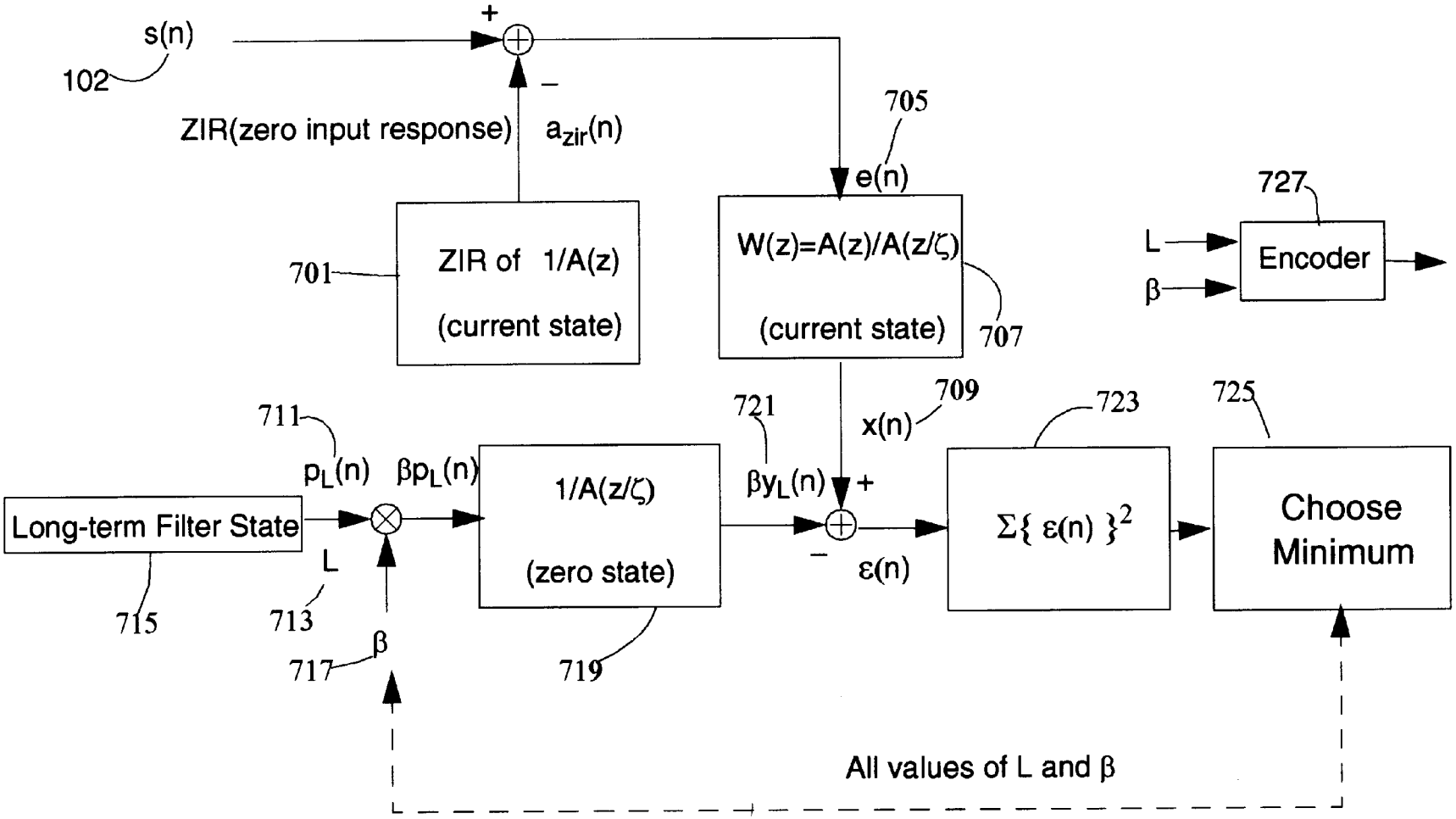
FIG. 7 shows the procedures in details how to extract parameters for the pitch filter.

FIG. 7 illustrates the process in details how to find the parameters for the pitch filter. In this scheme, pitch filter parameters are extracted by close-loop analysis. Zero input response of the LPC formant filter 1/A(z) 701 is subtracted from the input speech s(n) 102 to form an input signal e(n) 705 for the perceptual weighting filter W(z) 707. This perceptual weighting filter W(z) consists of two filters, LPC inverse filter A(z) and weighted LPC filter $1/A(z/\zeta)$ where ζ is the weighting filter constant and typical value of ζ is 0.8. The output of the perceptual weighting filter is denoted by x(n) 709 which is called "Target Signal" for pitch filter parameters.

The adaptive codebook output $p_L(n)$ 711 is generated depending on the pitch lag L 713 from the long-term filter state 715 of the pitch filter which is called "adaptive codebook". The adaptive codebook output signal with gain adjusted by β 717 is fed to the weighted LPC filter $1/A(z/\zeta)$ 719 to generate $\beta y_L(n)$ 721. Mean squared errors 723 between the target signal x(n) and the weighted LPC filter output $\beta y_L(n)$ are calculated for every possible value of L and β. Pitch filter parameters are selected that yield minimum mean squared error 725. The pitch filter parameters selected (pitch lag L and pitch gain β) are then encoded by the encoder 727 and transmitted to the decoder to generate decoded pitch filter parameters.

The search routines of the pitch parameters for all pitch lags including fractional pitch periods involve substantial calculations. The optimal long-term lags are usually fluctuating around actual pitch periods. In order to reduce the computations for the search of pitch filter parameters, an open-loop pitch period (integer pitch period) is searched using the windowed signal shown in FIG. 4. The actual search for the pitch parameters is limited around the open loop pitch period.

The open-loop pitch period can be extracted from the input speech signals s(n) 102 directly or it can be extracted from the LPC prediction error signals (output of A(z)). Pitch extraction from the LPC prediction error signals is preferred to the one from the speech signals directly, since the pitch excitation sources are shaped by the vocal tract in the process of human speech production system. In fact, pitch period appears to be disturbed mainly by the first two formants for the most voiced speech where these formants are eliminated in the LPC prediction error signals.

Figure 8:
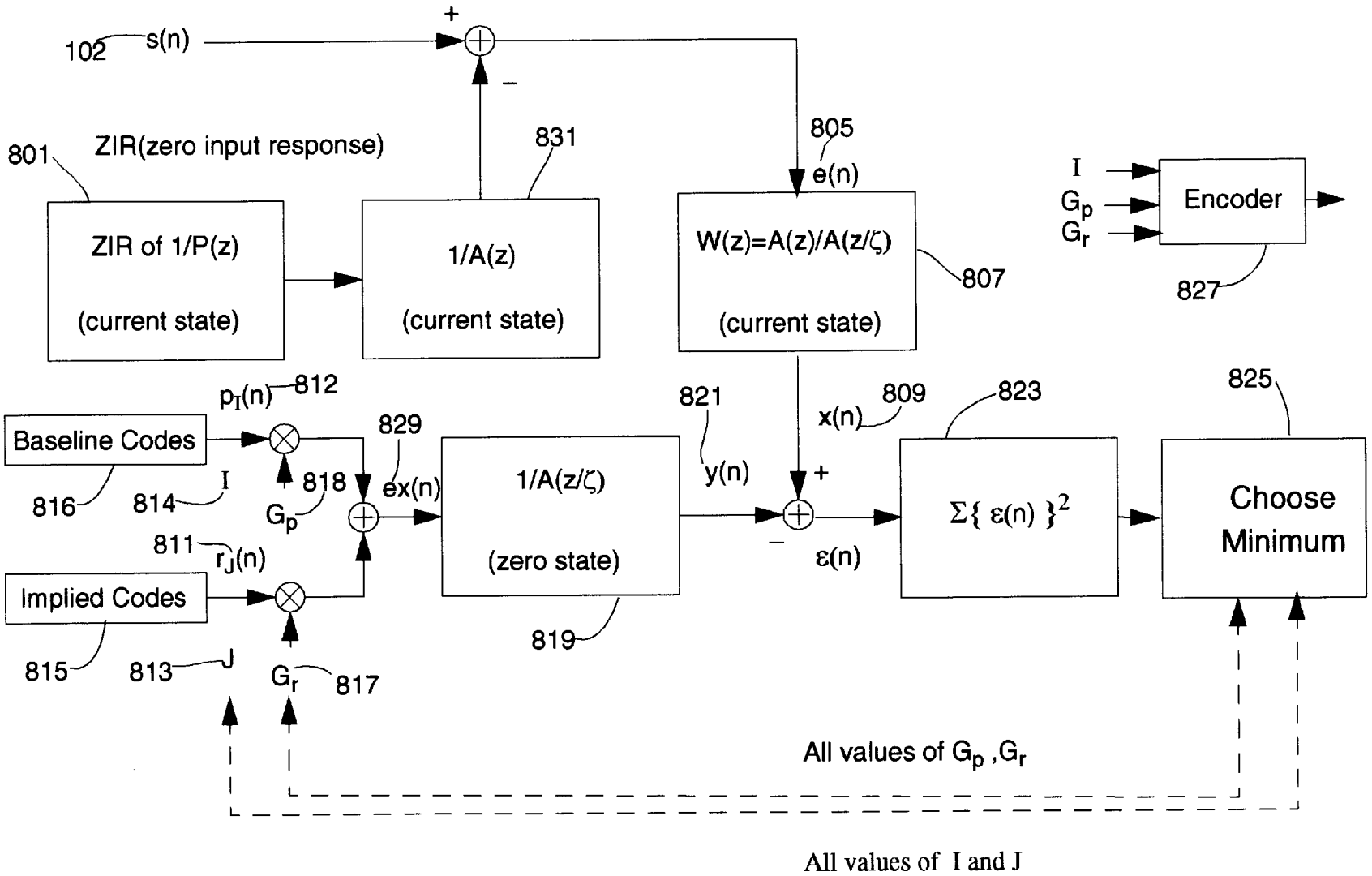
FIG. 8 shows the procedures in details how to extract codebook parameters for the generation of an excitation function.

FIG. 8 illustrates the process used to extract codebook parameters for the generation of an excitation function. The BI-CELP coder uses two excitation codevectors, one codevector from the baseline codebook and the other codevector from the implied codebook. If the baseline codevector is selected from the pulse codebook, then the implied codevector should be selected from the random codebook. Alternatively, if the baseline codevector is selected from the random codebook, then the implied codevector should be selected from the pulse codebook. This alternative selection is illustrated and described further in FIG. 10. In this way, the excitation functions always consist of pulse and random codevectors. The method to select the codevectors and gains is an analysis-by-sythesis technique similar to that used for the search procedures of pitch filter parameters.

Zero input response of the pitch filter 1/P(z) 801 is fed to the LPC filter 831 and the output of the filter 831 is subtracted from the input speech s(n) 102 to form an input signal e(n) 805 for the perceptual weighting filter W(z) 807. This perceptual weighting filter W(z) consists of two filters, LPC inverse filter A(z) and weighted LPC filter $1/A(z/\zeta)$ where $\zeta$ is the weighting filter constant and typical value of $\zeta$ is 0.8. The output of the perceptual weighting filter is denoted by x(n) 809 which is called "Target Signal" for codebook parameters.

The implied codebook output $r_J(n)$ 811 is generated depending on the codebook index J 813 from the implied codebook 815. Similarly, the baseline codebook output $p_I(n)$ 812 is generated depending on the codebook index I 814 from the baseline codebook 816. These codebook outputs, $r_J(n)$ and $p_I(n)$, with gains adjusted by $G_r$ 817 and $G_p$ 818, respectively, are summed to generate an excitation function ex(n) 829 and fed to the weighted LPC formant filter 819 to generate filter output y(n) 821. Mean squared errors 823 between the target signal x(n) 809 and the weighted LPC filter output y(n) 821 are calculated for every possible value of I, J, $G_p$, and $G_r$. These selected parameters (I, $G_p$, and $G_r$) that yield the minimum mean squared error 825 are then encoded by the encoder 827 for transmission and decoded for the synthesizer once per frame which may require a delay of one frame.

Figure 9:
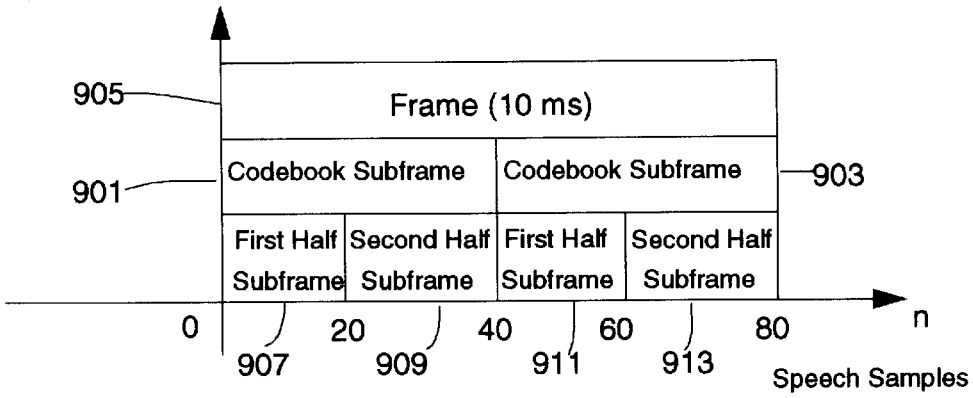
FIG. 9 illustrates the frame and subframe structures for the BI-CELP speech codec.

Referring to FIG. 9, there are two codebook subframes 901 & 903 in a frame 905 of 10 ms for a typical BI-CELP configuration. The codebook subframe 901 consists of two half-subframes 907, 909 of 2.5 ms each and the codebook subframe 903 consists of two half-subframes 911 & 913, also of 2.5 ms each.

Figure 10:
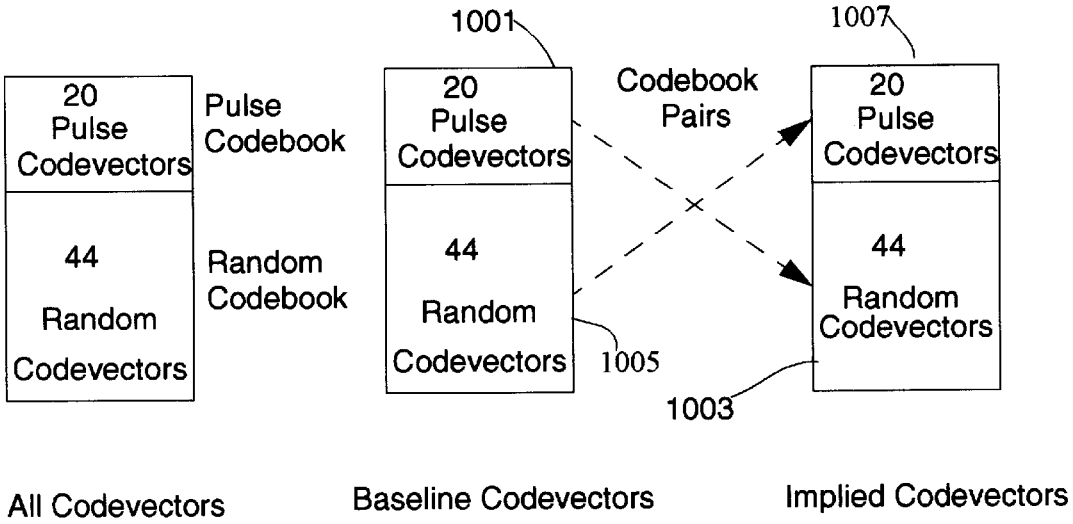
FIG. 10 shows the codebook structures and the relation between the baseline codebook and implied codebook.

Referring to FIG. 10, two codevectors are generated during each half-subframe, i.e., one from the baseline codebook and the other from the implied codebook. In addition, both the baseline codebook and implied codebook are comprised of a pulse codebook and a random codebook. Each of the random and pulse codebooks comprise a series of codevectors. If the baseline codevector is selected from the pulse codebook 1001, then the implied codevector should be selected from the random codebook 1003. Alternatively, if the baseline codevector is selected from the random codebook 1005, then the implied codevector should be selected from the pulse codebook 1007.

Figure 11:
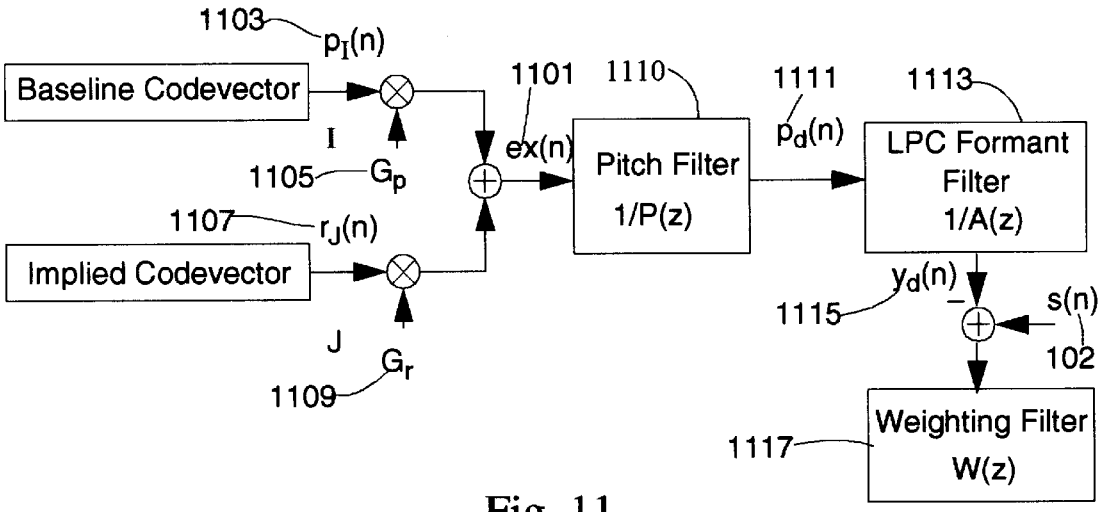
FIG. 11 shows the decoder block diagram in the transmitter side.
Figure 12:
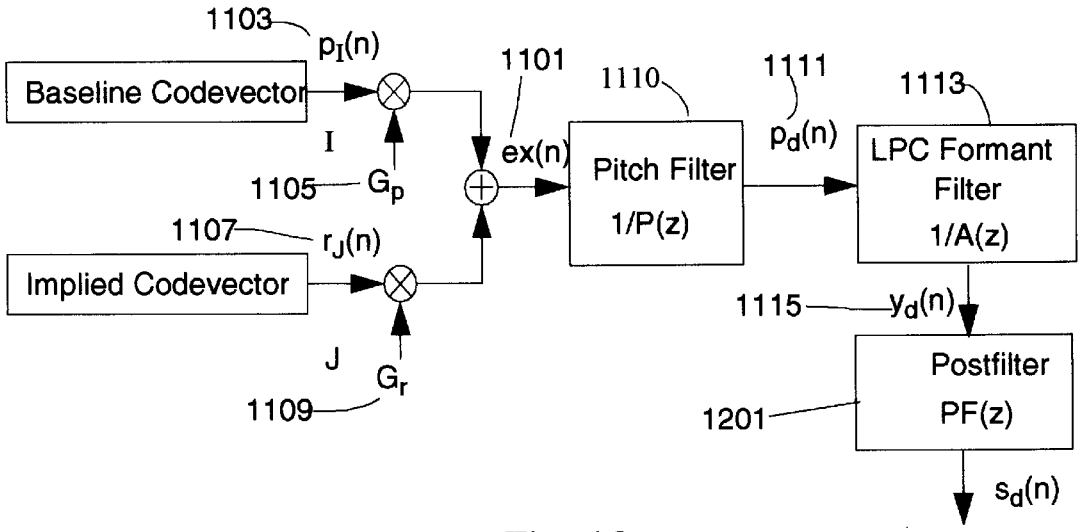
FIG. 12 shows the decoder block diagram in the receiver side.

FIG. 11 illustrates the speech decoder (synthesizer) at the transmitter side. FIG. 12 illustrates the speech decoder at the receiver side. A speech decoder is used at both the transmitter side and the receiver side, and both are similar. The decoding process of the transmitter is identical to the decoder process of the receiver if there is no channel error introduced during the data transmission. Additionally, the speech decoder at the transmitter side can be simpler than that of the receiver side since there is no transmission involved through the channel.

Referring to FIGS. 11 & 12, the parameters (LPC parameters, pitch filter parameters, codebook parameters) for the decoder are decoded in a manner similar to that shown in FIG. 2. The scaled codebook vector ex(n) 1101 is generated from the two scaled codevectors, one from the baseline codebook, $p_I(n)$ 1103 scaled by the gain $G_p$ 1105 and the other from the implied codebook, $r_J(n)$ 1107 scaled by the gain $G_r$ 1109. Since there are two half-subframes per codebook subframe, two scaled codevectors are generated, one for the first half-subframe and the other for the second half-subframe. The codebook gains are vector quantized from the vector quantization Table developed to optimize the average mean squared errors between the target signals and estimated signals.

Both the speech codecs of the transmitter and the receiver generate output of the pitch filter 1110, identically. The pitch filter output $p_d(n)$ 1111 is fed to the LPC formant filter 1113 to generate LPC synthesized speech $y_d(n)$ 1115.

The output of the LPC filter $y_d(n)$ is generated at both transmitting and receiving speech codecs using the same interpolated LPC prediction coefficients. These LPC prediction coefficients are converted from the LSP frequencies that are interpolated for every codebook subframe. The LPC filter outputs of the transmitting speech codec and receiving speech codec are generated from the pitch filter outputs as shown in FIG. 11 and FIG. 12, respectively. The final filter states are saved for use in searches for the pitch and codebook parameters in the transmitter. The filter states of the weighting filter 1117 at the transmitter side are calculated from the input speech signal s(n) 102 and the LPC filter output $y_d(n)$ 1115 and they may be saved or initialized with zeros depending on the applications for the next frames. Since the output of the weighting filter is not used at the transmitter side, the output of the weighting filter is not shown in FIG. 11. The post filter 1201 on the receiver side may be used to enhance the perceptual voice quality of the LPC formant filter output $y_d(n)$.

Figure 13:
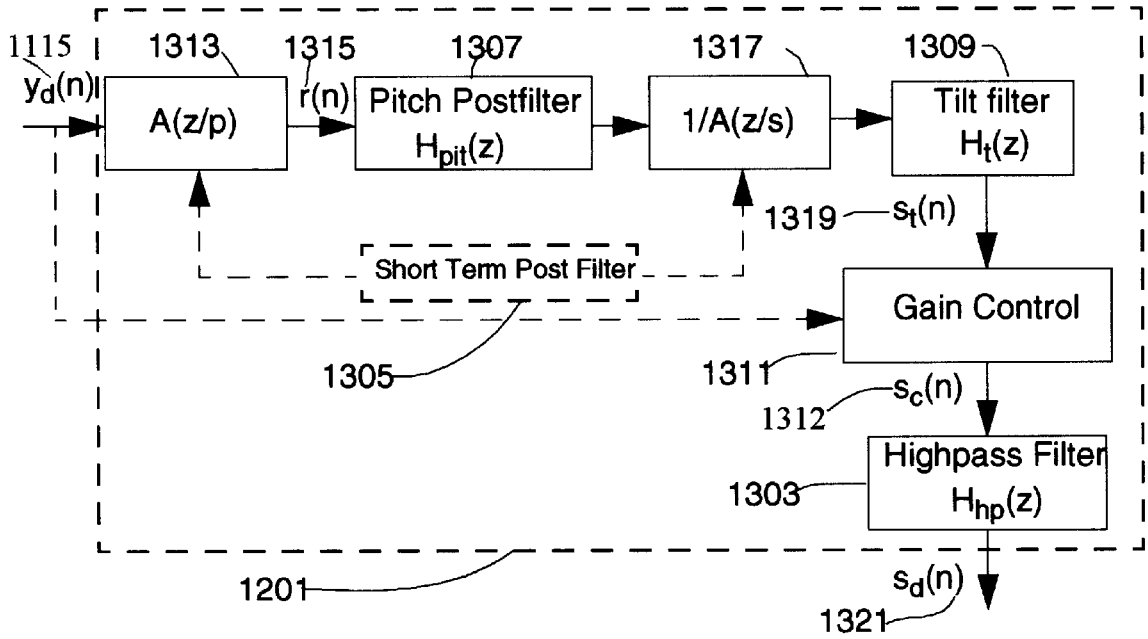
FIG. 13 shows the block diagram of the postfilter.

Referring to FIG. 13, the postfilter 1201 in FIG. 12 may be used as an option in the BI-CELP speech codec to enhance the perceptual quality of the output speech. The postfilter coefficients are updated every subframe. As shown in FIG. 13, the postfilter consists of two filters, an adaptive postfilter and a highpass filter 1303. In this scheme, the adaptive postfilter is a cascade of three filters: short-term postfilter $H_s(z)$ 1305, pitch postfilter $H_{pit}(z)$ 1307, and a tilt compensation filter $H_t(z)$ 1309, followed by an adaptive gain controller 1311.

The input of the adaptive postfilter, $y_d(n)$ 1115, is inverse filtered by the zero filter A(z/p) 1313 to produce the residual signals r(n) 1315. These residual signals are used to compute the pitch delay and gain for the pitch postfilter. The residual signals r(n) are then filtered through the pitch postfilter $H_{pit}(z)$ 1307 and all-pole filter 1/A(z/s) 1317. The output of the all-pole filter 1/A(z/s) is then fed to the tilt compensation filter $H_t(z)$ 1309 to generate the post filtered speech $s_t(n)$ 1319. The output of the tilt-filter $s_t(n)$ is gain controlled by the gain controller 1311 to match the energy of the postfilter input $y_d(n)$. The gain adjusted signal $s_c(n)$ 1312 is highpass filtered by the filter 1303 to produce the perceptually enhanced speech $s_d(n)$ 1321.

Referring again to FIG. 8, the excitation source ex(n) 829 for the weighted LPC formant filter 819 consists of two codevectors, $G_p\, p_i(n)$ 818 & 812 from the baseline codebook and $G_r\, r_j(n)$ 817 & 811 from the implied codebook for each half-subframe. Therefore, referring to FIG. 9, the excitation function for the codebook subframe of 5 ms (either 901 or 903) may be expressed as $$ex(n) = \begin{cases} G_{p1}p_{i1}(n) + G_{r1}r_{j1}(n) \text{ for } 0 \le n \le (N_h - 1) \\ G_{p2}p_{i2}(n) + G_{r2}r_{j2}(n) \text{ for } 20 \le n \le 39, \end{cases} \tag{8}$$

where $N_h$=20 and $p_{i1}(n)$ and $r_{j1}(n)$ are the i1-th baseline codevector and j1-th implied codevector, respectively, for the first half-subframe, and $P_{i2}(n)$ and $r_{j2}(n)$ are the i2-th baseline codevector and j2-th implied codevector, respectively, for the second half-subframe. The gains $G_{p1}$ and $G_{r1}$ are for the baseline codevector $p_{i1}(n)$ and the implied codevector $r_{j1}(n)$, respectively. The gains $G_{p2}$ and $G_{r2}$ are for the baseline codevector $p_{i2}(n)$ and the implied codevector $r_{j2}(n)$, respectively. The indices i1 and i2 are for the baseline codevector ranging from 1 to 64 which can be specified by using 6 bits. The indices j1 and j2 are for the implied codevectors. Referring to FIG. 10, the values of j1 and j2 may vary depending on the selected implied codebook, i. e., they range from 1 to 20 if they are selected from the implied pulse codebook 1007 and they range from 1 to 44 if they are selected from the implied random codebook 1003. The pulse codebook consists of 20 pulse codevectors as shown in Table 1 and the random codebook consists of 44 codevectors generated from a Gaussian number generator.

The indices i1 and i2 are quantized using 6 bits each which require 12 bits per codebook subframe while the four codebook gains are vector quantized using 10 bits.

TABLE 1

Pulse Position and Amplitude for Pulse Codebook

| Pulse # | Pulse Position | Pulse Amplitude |
|---|---|---|
| Pulse 1 | 1,2,3,4,5,6,7,8,9,10,11,12,13,14,15,16,17,18,19,20 | +1 |

Referring again to FIG. 8, the transfer function of the perceptual weighting filter 807 is the same as that used for the search procedure of pitch parameters, i.e., $$W(z) = \frac{A(z)}{A(z/\zeta)} = \frac{1 - \sum_{i=1}^{P} \hat{a}_i z^{-i}}{1 - \sum_{i=1}^{P} \hat{a}_i \zeta^i z^{-i}} \tag{9}$$

where A(z) is the LPC prediction filter and ζ equals 0.8. The LPC prediction coefficients used in the perceptual weighting filter are those for the current codebook subframe. The synthesis filter used in the speech encoder is called the weighted synthesis filter 819 whose transfer function is given by $$H(z) = W(z)\frac{1}{A(z)} = \frac{1}{A(z/\zeta)} \tag{10}$$

The weighted synthesized speech is the output of the codebooks filtered by the pitch filter and weighted LPC formant filter. The weighted synthesis filter and pitch filter will have filter states associated with them at the start of each subframe. In order to remove the effects of the pitch filter and the weighted synthesis filter's initial states from the subframe parameter determination, the zero input response of the pitch filter 801 filtered by the LPC formant filter 831 is calculated and subtracted from the input speech signal s(n) 102 and filtered by the weighting filter W(z) 807. The output of the weighting filter W(z) is the target signal x(n) 809 as shown in FIG. 8.

Codebook parameters are selected to minimize the mean squared error between the target signal 809 and the weighted synthesis filter's output 821 due to the excitation source specified in eq. (8). Even though the statistics of the target signal depend on the statistics of the input speech signal and coder structures, this target signal x(n) is normalized by the rms estimate as follows:

$$x_{norm}(n) = x(n)/\sigma_x,\ n=0, 1, \ldots, 39 \tag{11}$$

where the normalization constant $\sigma_x$ is estimated from the previous rms values of the synthesized speech.

The rms values of the synthesized speech in the previous codebook subframe may be expressed as $$U^{(m-1)} = \sqrt{\frac{1}{20}\sum_{n=20}^{39} p_d(n)^2} \tag{12}$$

$$U^{(m-2)} = \sqrt{\frac{1}{20}\sum_{n=0}^{(N_h-1)} p_d(n)^2} \tag{13}$$

where $\{p_d(n)\}$ 1111 shown in FIG. 11 & 12 are the pitch filter outputs in the previous codebook subframe and m represent the subframe number.

Converting these rms values in dB scales, we have $$u^{(m-1)} = 20 \log U^{(m-1)} \tag{14}$$

$$u^{(m-2)} = 20 \log U^{(m-2)} \tag{15}$$

The normalization constant $\sigma_x(m)$ for subframe m in dB scale is estimated as $$rd(m) = 20\log\sigma_x(m) = \sum_{i=1}^{4} b_i[u^{(m-i)} - \overline{u}] + \overline{rd}, \tag{16}$$

where $\overline{rd}$=36.4, $\overline{u}$=30.7, $b_1$=0.459, $b_2$=0.263, $b_3$=0.175, $b_4$=−0.127.

This estimated normalization constant is modified as $rd_{new}(m)=[rd(m)+rd(m-1)]/2$, if $rd(m)<rd(m-1)$ The value of rd(m) is rounded to the nearest second decimal point for the purpose of synchronization between the processors of transmitter and receiver. Therefore, the normalization constant for the subframe m may be expressed as $$\sigma_x(m) = 10^{rd(m)/20} \tag{18}$$

Since the codebook gains of eq.(8) are also normalized by $\sigma_x(m)$, the actual excitation source must be multiplied by $\sigma_x(m)$. In this way, the dynamic ranges of the codebook gains are reduced, thereby increasing the coding gains of the vector quantizer for the codebook gains.

The codebook parameters of eq. (8) are searched and selected in three steps as follows:

(1) Implied codevectors are identified for the first half codebook subframe and for the second half codebook subframe.

(2) K sets of codebook index (baseline codebook index and implied codebook index) are searched for the first half codebook subframe and L sets of codebook index are searched for the second half codebook subframe.

(3) one set of codebook parameters is selected from the K×L candidates of procedure (2)

As an example of a typical BI-CELP implementation, the variables K and L are chosen to be 3 and 2, respectively with good voice quality.

Step 1: Computing the Implied Codebook Index

The selection of the implied codevector depends on the selection of the baseline codevector, i.,e., implied codevector should be selected from the pulse codebook if the baseline codevector is selected from the random codebook and implied random codevector should be selected if the baseline codevector is selected from the pulse codebook. Since the baseline codevector is not selected at this stage, two possible candidates of implied codevectors are searched for every half codebook subframe, i.e., one from the pulse codebook and the other from the random codebook.

Referring again to FIGS. 1, 2, 11 & 12, implied codevectors are selected that minimize the mean squared error between the synthesized speech with pitch period delay and the LPC formant filter output due to the excitation from the implied codevectors. Therefore, the pitch delayed signal (the synthesized speech with pitch period delay), pd(n), is calculated for the current codebook subframe as $$pd(n)=y_d(n-\tau),\ n=0, 1, \ldots, 39 \tag{17}$$

where $\tau$ is the pitch delay and $y_d(n)$ 1115 is the output of the LPC formant filter 1113. If the pitch delay $\tau$ is a fractional number, then the pitch delayed signal, pd(n), is obtained by interpolation. This target signal is modified by subtracting the zero input response of the pitch filter filtered by the LPC formant filter, i.e., $$pd(n)=pd(n)-pd_{zir}(n),\ n=0, 1, \ldots, 39, \tag{18}$$

where $pd_{zir}(n)$ is the zero input response of the LPC formant filter 1/A(z) 1113 and pitch filter 1/P(z) 1110.

The zero state response of the LPC formant filter for the first half-subframe is then calculated as $$u_j(n) \cong \sum_{i=0}^{\min(n,N_h-1)} h_L(i)x_j(n-i),\ 0 \le n \le (N_h-1), \tag{19}$$

where $x_j(n)$ is the j-th codevector of the implied codebook and $h_L(i)$ is the impulse response of the LPC formant filter 1/A(z) 1113. The zero state output may be approximated by eq. (19) or it may be calculated by the all polefilter.

Two implied codevector candidates are selected for the first half codebook subframe that minimize the following mean squared error;

$$E_j = \sum_{n=0}^{N_h-1} [pd(n) - G_j u_j(n)]^2, \tag{20}$$

where $G_j$ is the gain for the j-th codevector, i.e., one implied codevector (codebook index j1p) from the pulse codebook and the other implied codevector (codebook index j1r) from the random codebook.

Similarly, two other implied codevectors are selected for the second half codebook subframe that minimize the following mean squared error;

$$E_j = \sum_{n=0}^{N_h-1} [pd(n+20) - G_j u_j(n)]^2, \tag{21}$$

i.e., one implied codevector (codebook index j2p) from the pulse codebook and the other implied codevector (codebook index j2r) from the random codebook.

In this way four implied codevectors for a codebook subframe are prepared for the search of the codebook parameters.

Step: 2 Computing the Sets of Codebook Index

Defining the output of the weighted LPC filter due to baseline codebook index i1 as $h_{p1}(n)$ and the output of the weighted LPC synthesis filter due to implied codebook index j1 as $h_{r1}(n)$, i.e., $$h_{p1}(n) = \sum_{i=0}^{\min(n,N_h-1)} h(i)p_{i1}(n-i),\ 0 \le n \le (N_h-1), \tag{22}$$

$$h_{r1}(n) = \sum_{i=0}^{\min(n,N_h-1)} h(i)r_{j1}(n-i),\ 0 \le n \le (N_h-1), \tag{23}$$

where {h(i)}, i=1, . . . , 20 are the impulse response ofthe weighted LPC filter H(z) of eq. (10).

The total minimum squared error, $E_{min}$, may be expressed as $$\begin{aligned} E_{\min} &= \sum_{n=0}^{19} ([x(n) - G_{p1}h_{p1}(n) - G_{r1}h_{r1}(n)])^2 \\ &= \sum_{n=0}^{19} x^2(n) - \frac{b3b4^2 + b1b5^2 - 2b2b4b5}{b1b3 - b2^2}, \end{aligned} \tag{24}$$

where $$b1 = \sum_{n=0}^{19} \{h_{p1}(n)\}^2 \tag{25}$$

$$b2 = \sum_{n=0}^{19} \{h_{p1}(n)h_{r1}(n)\} \tag{26}$$

$$b3 = \sum_{n=0}^{19} \{h_{r1}(n)\}^2 \tag{27}$$

$$b4 = \sum_{n=0}^{19} \{h_{p1}(n)x(n)\} \tag{28}$$

-continued $$b5 = \sum^{19} \{h_{rl}(n)x(n)\}. \tag{29}$$

This minimum mean squared error $E_{min}$ is calculated for a given baseline codebook index i1 and implied codebook index j1. The corresponding optimum gains $G_{p1}$ and $G_{r1}$ may be expressed as $$G_{pl} = \frac{b3b4 - b2b5}{b1b3 - b2^2}, \tag{30}$$

$$G_{rl} = \frac{b1b5 - b2b4}{b1b3 - b2^2}. \tag{31}$$

Implied codebook index j1p is used for the pulse baseline codebook index (i1: 1–20) and implied codebook index j1r is used for the random baseline codebook index (i1: 21–64). K baseline indices $\{i1_k\}$, k=1,K are selected along with the corresponding implied codebook index that provide the first K smallest mean squared errors in eq. (24).

The selection of the codebook index for the second half codebook subframe is depending on the selection of the codevectors for the first half codebook subframe, i.e., zero input response of the weighted LPC filter due to the first half subframe's codevectors must be subtracted from the target signal for the optimization of second half codebook subframe as follows:

$$x_{new}(n)=x(n)-G_{p1}h_{p1}(n)-G_{r1}h_{r1}(n),\ n=20, 21, \ldots, 39, \tag{32}$$

where $G_{p1}$ and $G_{r1}$ are the codebook gains of eq.(30) and eq. (31), respectively and $h_{p1}(n)$ and $h_{r1}(n)$ are the zero input responses of eq. (22) and eq. (23), respectively. Therefore, the new target signal is defined for the second half codebook subframe depending on the codevectors selected for the first half codebook subframe.

Similar to the procedure for the first half codebook subframe, for a selected index of $i1_k$, L baseline indices $\{i2_l\}$, l=1,L are selected along with the corresponding implied codebook index j2 (j2p or j2r) that provide the smallest mean squared error.

In this step, only K×L candidate sets of codebook index are identified and final selection of index set and codebook gains are determined in the following step.

Step: 3 Final Selection of the Codebook Parameters

Final codebook indices and codebook gains are selected depending on the smallest mean squared error between the target signal (unmodified target signal by the zero input response due to first half subframe's codevectors) and the output of the weighted LPC formant filter due to all possible excitation sources (among K×L sets of index and all possible set of codebook gains).

Defining the output of the weighted LPC formant filter due to excitation codevectors as $$y_{pl}(n) = G_{pl}h_{pl}(n) = \sum_{i=0}^{\min(n,N_h-1)} h(i)G_{pl}p_{il}(n-i) \tag{33}$$

$$y_{rl}(n) = G_{rl}h_{rl}(n) = \sum_{i=0}^{\min(n,N_h-1)} h(i)G_{rl}r_{jl}(n-i) \tag{34}$$

-continued $$y_{p2}(n+20) = G_{p2}h_{p2}(n+20) = \sum_{i=0}^{\min(n,N_h-1)} h(i)G_{p2}p_{i2}(n-i) \tag{35}$$

$$y_{r2}(n+20) = G_{r2}h_{r2}(n+20) = \sum_{i=0}^{\min(n,N_h-1)} h(i)G_{r2}r_{j2}(n-i) \tag{36}$$

where n ϵ [0, 19], and the codevectors $p_{i1}(n)$, $r_{j1}(n)$ are assumed to be zero outside the window of n>20. The outputs of the weighted synthesis filter due to excitation codevectors for the second half codebook subframe are also assumed to be zero during the first half codebook subframe.

In these equations, the filter outputs, $h_{p1}(n)$, $h_{r1}(n)$, $h_{p2}(n)$, $h_{r2}(n)$, are the weighted synthesis filter outputs due to excitation codevectors with unit gain.

Now the mean squared error for the codebook subframe may be expressed as $$\begin{aligned} E_{\min} &= \sum_{n=0}^{39} [x(n) - y_{pl}(n) - y_{rl}(n) - y_{p2}(n) - y_{r2}(n)]^2 \\ &= \sum_{n=0}^{39} [x(n) - G_{pl}h_{pl}(n) - G_{rl}h_{rl}(n) - G_{p2}h_{p2}(n) - G_{r2}h_{r2}(n)]^2 \end{aligned} \tag{37}$$

Since the filter responses, $h_{p1}(n)$, $h_{r1}(n)$, $h_{p2}(n)$ $h_{r2}(n)$, are known for a specific set of codebook index, minimum mean squared error can be searched among the available sets $\{G_{p1}, G_{r1}, G_{p2}, G_{r2}\}$ of codebook gains. Since the characteristics of the codebook gains are different for the pulse codevectors and random codevectors, four tables of vector quantization for codebook gains are prepared for the calculation of mean squared error depending on the selection of the baseline codevectors. If the baseline codevector of the first half codebook subframe is from the pulse codebook and if the baseline codevector of the second half codebook subframe is from the pulse codebook, then VQ table of VQT-PP is used for the calculation of mean squared error of eq. (37). Similarly the VQ tables of VQT-PR, VQT-RP, VQT-RR are used if the sequence of the baseline codevectors are (pulse, random), (random, pulse), (random, random), respectively.

These sets, $\{G_{p1}, G_{r1}, G_{p2}, G_{r2}\}$, of codebook gains are trained from a large data base to minimize the average mean squared error of eq. (37). In order to reduce the memory size of the table and CPU requirement, only positive sets of codebook gains are prepared. In this way the memory size ofthe VQ table is reduced by 1/16. The sign bits of the quantized gains are copied from the unquantized gains of $\{G_{p1}, G_{r1}, G_{p2}, G_{r2}\}$ in order to reduce CPU load.

Voicing decisions are made from the decoded LSPs and pitch gain for every subframe of 5 ms in the transmitter and receiver as follows:

1. Average LSP for the low vector is calculated per frame, i.e., $$lspl = \frac{(lsp_1 + lsp_2 + lsp_3 + lsp_4)}{4}. \tag{38}$$

2. Voicing (nv=1: voiced, nv=0: unvoiced) decision is made per subframe from the average LSP and pitch gain, i.e., $$\begin{aligned} &if\,(lspl \geq 0.0892) \\ &\quad if\,(pg \in [0.94, 1.14])\ \text{then nv} = 1 \\ &\qquad\qquad \text{else nv} = 0 \end{aligned} \tag{39}$$

or $$\begin{aligned} &if\,(lspl < 0.0892) \\ &\quad if\,(pg \in [0.71, 1.45])\ \text{then nv} = 1 \\ &\qquad\qquad \text{else nv} = 0. \end{aligned} \tag{40}$$

If the voicing decision is unvoiced, i.e., nv=0, then the target signal for the implied codebook is replaced by $$\begin{aligned} pd(n) &= h(n) - 1.0 \qquad \text{for } n = 0, 1, \ldots, 19 \\ pd(n) &= h(n-20)^2 - 1.0 \quad \text{for } n = 20, 21, \ldots, 39. \end{aligned} \tag{40}$$

Voicing decision provides two advantages for the BI-CELP invention. The first one is to reduce the perceived level of modulated background noise during the silence or unvoiced speech segments since the presence of the implied codebook is no longer required to reproduce pitch related harmonics. The second one is to reduce the sensitivity of the BI-CELP performance under channel errors or frame erasures. This advantage is due to the fact that the filter states of the transmitter programs and receiver programs will be synchronized since the feedback loop of the implied codebook is removed during the unvoiced segments.

Single tone can be detected from the decoded LSPs in the transmitter and receiver. During the process of checking the stability of the system, single tone is detected if LSP spreading is modified twice contiguously. In this case the target signal for the implied code vector is replaced by the one described for the case of unvoiced segments.

Referring to the postfilter shown in FIG. 13, the transfer function of the short term postfilter 1305 is defined by $$H_s(z) = \frac{A(z/p)}{A(z/s)}, \tag{42}$$

where A(z) is the LPC prediction filter and p=0.55, s=0.80. This short term filter is separated into two filters, i.e., zero filter A(z/p) 1313 and pole filter 1/A(z/s) 1317. The output of the zero filter A(z/p) is first fed to the pitch post filter 1307 followed by pole filter 1/A(z/s).

The pitch postfilter 1307 is modeled as a first order zero filter as $$H_{pit}(z) = \frac{1}{1 + \gamma_p g_{pit}}(1 + \gamma_p g_{pit} z^{-T_c}), \tag{43}$$

where $T_c$ is the pitch delay for the current subframe, and $g_{pit}$ is the pitch gain. The constant factor $\gamma_p$ controls the amount of pitch harmonics. This pitch postfilter is activated for the subframes of steady pitch period (i.e., stationary subframes). If the change of the post pitch period is larger than 10%, then the pitch post filter is removed, i.e., $$pv = \frac{|T_c - T_p|}{T_c}, \tag{44}$$

where pv is the pitch variation index and Tp is the pitch period of the previous subframe. If this pitch period variation is within 10%, then the pitch gain control parameter $\gamma_p$ is calculated as follows:

$$\gamma_p = 0.6 - 0.005(T_c - 19.0) \tag{45}$$

where the range of this parameter is from 0.25 to 0.6. Both the pitch delay and pitch gain are calculated from the residual signal r(n) 1315 obtained by filtering $y_d(n)$ 1115 through zero filter A(z/p) 1313, i.e., $$r(n) = y_d(n) - \sum_{i=1}^{10} p^i a_i y_d(n-i). \tag{46}$$

The pitch delay is computed using a two-pass procedure. First, the best integer pitch period $T_0$ is selected in the range $[\lfloor T_1 \rfloor^{-1}, \lfloor T_1 \rfloor^{+1}]$, where $T_1$ is the received pitch delay from the transmitter and $\lfloor x \rfloor$ is the floor function that provide the largest integer which is less or equal to x. The best integer delay is the one that maximizes the correlation $$R(k) = \sum_{n=0}^{39} r(n) r(n-k). \tag{47}$$

The second pass chooses the best fractional pitch delay $T_c$ with ¼ resolution around $T_0$. This is done by finding the delay with the highest pseudo-normalized correlation $$R'(k) = \frac{\sum_{n=0}^{39} r(n) r_k(n)}{\sqrt{\sum_{n=0}^{39} r_k(n)^2}}, \tag{48}$$

where $r_k(n)$ is the residual signal r(n) at delay k Once the optimal delay $T_c$ is found, the corresponding correlation $R'(T_c)$ is normalized with the rms value of r(n). The square of this normalized correlation is used to determine whether the pitch post filter should be disabled, which will be done by setting $g_{pit}=0$, if $$\frac{R'(T_c)^2}{\sum_{n=0}^{39} r(n)^2} < 0.5. \tag{49}$$

Otherwise the value of $g_{pit}$ is computed from $$g_{pit} = \frac{\sum_{n=0}^{39} r(n) r_k(n)}{\sum_{n=0}^{39} r_k(n)^2}, \qquad 0 \leq g_{pit} \leq 1 \tag{50}$$

Note that the pitch gain is bounded by 1, and it is set to zero if the pitch prediction gain is less than 0.5. The fractional delayed signal $r_k(n)$ is computed using an hamming interpolation window of length 8.

The first order zero filter $H_t(z)$ 1309 compensates for the tilt in the short term postfilter $H_s(z)$ and is given by $$H_t(z)=(1+\gamma_t k'_1 z^{-1}) \tag{51}$$

where $\gamma_t k'_1$ is a tilt factor and it is fixed as $$\gamma_t k'_1=-0.3. \tag{52}$$

Adaptive gain control is used to compensate for the gain difference between the LPC formant filter output, $y_d(n)$ 1301 and tilt filter output $s_t(n)$ 1319. First, the power of the input is measured as $$p_i(n)=(1-a)p_i(n-1)+ay_d(n)^2 \tag{53}$$

and the power of the tilt filter output is measured as $$p_o(n)=(1-a)p_o(n-1)+as_t(n)^2 \tag{54}$$

where the value of a may be varied depending on the applications and it is set to 0.01 in BI-CELP codec. The initial values of power are set to zeros.

The gain factor is defined as $$g(n)=\sqrt{\frac{p_i(n)}{p_0(n)}}. \tag{55}$$

Therefore, the output 1312 of the gain controller 1311 may be expressed as $$s_c(n)=g(n)s_t(n) \tag{56}$$

Since the gain of eq. (55) requires CPU intensive computation of a square root, this gain calculation is replaced as follows:

$$\begin{aligned} &if\,(p_i(n) > p_o(n))\text{ then} \\ &\qquad \delta(n) = 0.001 \\ &\text{else} \\ &\qquad \delta(n) = -0.001 \end{aligned} \tag{57}$$

where $\delta(n)$ is the small gain adjustment for the current sample. The actual gain is computed as $$g(n) = g(n-1) + \frac{\delta(n)+\delta(n-1)}{2} \text{ for } n = 1, \ldots, 40. \tag{58}$$

where g(0) is initialized to one and the range of g(n) is [0.8,1.2].

The output $s_c(n)$ of the gain controller is highpass filtered by the filter 1303 with a cutoff frequency of 100 Hz. The transfer function of the filter is given by $$H_{hp}(z) = \frac{0.93981 - 1.87958z^{-1} + 0.93981z^{-2}}{1 - 1.93307z^{-1} + 0.93589z^{-2}}. \tag{59}$$

The output of the highpass filter $s_d(n)$ 1321 is fed into D/A converter to generate the received analog speech signal.

The above-described invention is intended to be illustrative only. Numerous alternative implementation of the invention will be apparent to those of ordinary skill in the art and may be devised without departing from the scope of the following claims.

What is claimed is:

1. A method for speech coding based on a code excited linear prediction (CELP) model comprising:

(a) dividing speech at a sending station into discrete speech samples;

(b) digitizing the discrete speech samples;

(c) forming a mixed excitation function by selecting a combination of two codevectors from two fixed codebooks, each having a plurality of codevectors, and selecting a combination of two codebook gain vectors from a plurality of codebook gain vectors;

(d) selecting an adaptive codevector from an adaptive codebook, and selecting a pitch gain in combination with the mixed excitation function to represent the digitized speech;

(e) encoding one of the two selected codevectors, both of the selected codebook gain vectors, the adaptive codevector and the pitch gain as a digital data stream;

(f) sending the digital data stream from the sending station to a receiving station using transmission means;

(g) decoding the digital data stream at the receiving station to reproduce the selected codevector, the two codebook gain vectors, the adaptive codevector, the pitch gain, and LPC filter parameters;

(h) reproducing a digitized speech sample at the receiving station using the selected codevector, the two codebook gain vectors, adaptive codevector, the pitch gain, and the LPC filter parameters;

(i) converting the digitized speech sample at the receiving station into an analog speech sample; and (j) combining a series of analog speech samples to reproduce the coded speech; and wherein encoding one of the two selected codevectors, both of the selected codebook gain vectors, the adaptive codevector and pitch gain as a digital data stream further comprises:

adjusting the baseline codevector by the baseline gain and adjusting the implied codevector by the implied gain to form a mixed excitation function;

using the mixed excitation function as an input to a pitch filter;

using the output of the pitch filter as an input of a linear predictive coding synthesis filter; and subtracting the output from the linear predictive coding synthesis filter from the speech to form an input to a weighting filter.

2. The method for speech coding based on a code excited linear prediction (CELP) model of claim 1 wherein the two fixed codebooks further comprise:

(a) selecting the first of the combination of two codevectors from a pulse codebook with a plurality of pulse codevectors; and (b) selecting the second of the combination of two codevectors from a random codebook with a plurality of random codevectors.

3. The method for speech coding based on a code excited linear prediction (CELP) model of claim 1 wherein the two fixed codebooks further comprise:

(a) selecting the first of the combination of two codevectors from a baseline codebook with a plurality of baseline codevectors; and (b) selecting the second of the combination of two codevectors from an implied codebook with a plurality of implied codevectors.

4. The method for speech coding based on a code excited linear prediction (CELP) model of claim 3 further comprising:

(a) selecting the implied codevector from a random codebook, which is within the baseline codebook and the implied codebook, when the baseline codevector is selected from the pulse codebook, and (b) selecting the implied codevector from a pulse codebook, which is within the baseline codebook and within the implied codebook, when the baseline codevector is selected from the random codebook.

5. The method for speech coding based on a code excited linear prediction (CELP) model of claim 1 further comprising:

(a) representing the plurality of codevectors with a codebook index; and (b) representing the adaptive codevector with an adaptive codebook index, wherein the indices and codebook gain vectors are encoded as the digital data stream.

6. The method for speech coding based on a code excited linear prediction (CELP) model of claim 1 further comprising:

(a) providing an implied codebook for at least one of the fixed codebooks, wherein the implied codebook further comprises;

(b) providing an encoder means; and (c) providing a decoder means.

7. The method for speech coding based on a code excited linear prediction (CELP) model of claim 6 wherein the encoder means further comprises:

(a) high pass filtering the speech;

(b) dividing the speech into frames of speech;

(c) providing autocorrelation calculation of the frames of speech;

(d) generating prediction coefficients from the speech samples using linear prediction coding analysis;

(e) bandwidth expanding the prediction coefficients;

(f) transforming the bandwidth expanded prediction coefficients into line spectrum pair frequencies;

(g) transforming the line spectrum pair frequencies into line spectrum pair residual vectors;

(h) split vector quantizing the line spectrum pair residual vectors;

(i) decoding the line spectrum pair frequencies;

(j) interpolating the line spectrum pair frequencies;

(k) converting the line spectrum pair frequencies to linear coding prediction coefficients;

(l) extracting pitch filter parameters from the frames of speech;

(m) encoding the pitch filter parameters; and (n) extracting mixed excitation function parameters from the baseline codebook and the implied codebook.

8. The method for speech coding based on a code excited linear prediction (CELP) model of claim 7 wherein split vector quantizing the line spectrum pair residual vectors further comprises:

(a) separating the line spectrum pair residual vectors into a low group and a high group;

(b) removing bias from the line spectrum pair residual vectors;

(c) calculating a residual for each line spectrum pair residual vector with a moving average predictor and a quantizer; and (d) generating a line spectrum pair transmission code as an output from the quantizer.

9. The method for speech coding based on a code excited linear prediction (CELP) model of claim 7 wherein decoding the line spectrum pair frequencies further comprises:

(a) dequantizing the line spectrum pair residual vectors;

(b) calculating zero mean line spectrum pairs from the dequantized line spectrum pair residual vectors; and (c) adding bias to the zero mean line spectrum pairs to form the line spectrum pair frequencies.

10. The method for speech coding based on a code excited linear prediction (CELP) model of claim 7 wherein extracting pitch filter parameters from the frames of speech further comprises:

(a) providing a zero input response;

(b) providing a perceptual weighting filter;

(c) subtracting the zero input response from the speech to form an input to the perceptual weighting filter;

(d) providing a target signal, which further comprises the output from the perceptual weighting filter;

(e) providing a weighted LPC filter;

(f) adjusting the adaptive codevector by the adaptive gain to form an input to the weighted LPC filter;

(g) determining the difference between the output from the weighted LPC filter and the target signal;

(h) finding the mean squared error for all possible combinations of adaptive codevector and adaptive gain; and (i) selecting the adaptive codevector and adaptive gain that correlate to the minimum mean squared error as the pitch filter parameters.

11. The method for speech coding based on a code excited linear prediction (CELP) model of claim 7 wherein extracting mixed excitation function parameters further comprises:

(a) subtracting a zero input response of a pitch filter from the speech to form an input to a perceptual weighting filter;

(b) generating a target signal, which comprises the output from the perceptual weighting filter;

(c) adjusting the baseline codevector with the baseline gain and adjusting the implied codevector with the implied gain to form the mixed excitation function;

(d) using the mixed excitation function as an input to a weighted LPC filter;

(e) determining the difference between the output of the weighted LPC filter and the target signal;

(f) finding the mean squared error for all possible combinations of baseline codevector, baseline gain, implied codevector and implied gain; and (g) selecting the baseline codevector, baseline gain, implied codevector and implied gain based on the minimum mean squared error as the mixed excitation parameters.

12. The method for speech coding based on a code excited linear prediction (CELP) model of claim 6 wherein the decoder means further comprises:

(a) generating the mixed excitation function from the baseline codebook and the implied codebook using the selected baseline codevector and implied codevector;

(b) generating an input to a linear predictive coding synthesis filter from the mixed excitation function and the adaptive codebook using the selected adaptive codevector;

(c) calculating an implied codevector from the output of the linear predictive coding synthesis filter;

(d) providing feedback of the calculated pitch filter output to the adaptive codebook;

(e) post filtering the output from the linear predictive coding synthesis filter; and (f) producing a perceptually weighted speech from the post filtered output.

13. A method for speech coding based on a code excited linear prediction (CELP) model comprising:

(a) dividing speech at a sending station into discrete speech samples;

(b) digitizing the discrete speech samples;

(c) forming a mixed excitation function by selecting a combination of two codevectors from two fixed codebooks, each having a plurality of codevectors, and selecting a combination of two codebook gain vectors from a plurality of codebook gain vectors;

(d) selecting an adaptive codevector from an adaptive codebook, and selecting a pitch gain in combination with the mixed excitation function to represent the digitized speech;

(e) encoding one of the two selected codevectors, both of the selected codebook gain vectors, the adaptive codevector and the pitch gain as a digital data stream;

(f) sending the digital data stream from the sending station to a receiving station using transmission means;

(g) decoding the digital data stream at the receiving station to reproduce the selected codevector, the two codebook gain vectors, the adaptive codevector, the pitch gain, and LPC filter parameters;

(h) reproducing a digitized speech sample at the receiving station using the selected codevector, the two codebook gain vectors, adaptive codevector, the pitch gain, and the LPC filter parameters;

(i) converting the digitized speech sample at the receiving station into an analog speech sample; and (j) combining a series of analog speech samples to reproduce the coded speech wherein the two fixed codebooks further comprise:

selecting the first of the combination of two codevectors from a baseline codebook with a plurality of baseline codevectors; and selecting the second of the combination of two codevectors from an implied codebook with a plurality of implied codevectors, wherein reproducing a digitized speech sample at the receiving station using the selected codevector, the two codebook gain vectors, adaptive codevector, the pitch gain, and the LPC filter parameters further comprises:

adjusting the baseline codevector by the baseline gain and adjusting the implied codevector by the implied gain to form the mixed excitation function;

using the mixed excitation function as an input to a pitch filter;

using the output from the pitch filter as an input to an LPC filter;

postfiltering the output of the LPC filter; and producing a digitized speech sample from the output from the LPC filter.

14. The method for speech coding based on a code excited linear prediction (CELP) model of claim 14 wherein post filtering the output of the LPC filter further comprises:

(a) inverse filtering the output of the LPC filter with a zero filter to produce a residual signal;

(b) operating on the residual signal outpt of the zero filter with a pitch post filter;

(c) operating on the output of the pitch post filter with an all-pole filter;

(d) operating on the output of the all-pole filter with a tilt compensation filter to generate post-filtered speech;

(e) operating on the output of the tilt compensation filter with a gain control to match the energy of the postfilter input; and (f) operating on the output of the gain control with a highpass filter to produce perceptually enhanced speech.

15. A method of encoding a speech signal comprising:

adjusting a baseline codevector by a baseline gain and adjusting an implied codevector by an implied gain to form a mixed excitation function;

using the mixed excitation function as an input to a pitch filter;

using the output of the pitch filter as an input of a linear predictive coding synthesis filter; and producing an encoded speech signal based on an output of the predictive coding synthesis filter.

16. The method of claim 15, further comprising subtracting an output from the linear predictive coding synthesis filter from the speech signal to form an input to a weighting filter.

17. The method of claim 16, wherein the speech signal comprises digitized speech produced by digitizing discrete speech samples.

18. The method of claim 17, wherein the mixed excitation function is formed by selecting a combination of two codevectors from two fixed codebooks, each having a plurality of codevectors, and selecting a combination of two codebook gain vectors from a plurality of codebook gain vectors.

19. The method of claim 18, further comprising selecting an adaptive codevector from an adaptive codebook, and selecting a pitch gain in combination with the mixed excitation function to represent the digitized speech.

20. The method of claim 19, further comprising encoding one of the two selected codevectors, both of the selected codebook gain vectors, the adaptive codevector and the pitch gain as a digital data stream.

21. A method for speech coding comprising:

forming a mixed excitation function by selecting a first of a combination of codevectors from a baseline codebook having a plurality of baseline codevectors and by selecting a second of the combination of codevectors from an implied codebook having a plurality of implied codevectors;

extracting mixed excitation function parameters from the baseline codebook and the implied codebook; and producing an encoded speech signal based on the mixed excitation function parameters.

22. The method of claim 21, further comprising selecting a combination of two codebook gain vectors from a plurality of codebook gain vectors.

23. The method of speech coding of claim 22, further comprising encoding one of the selected codevectors, both of the selected codebook gain vectors, the adaptive codevector, and the pitch gain as a digital data stream.

24. The method of speech coding of claim 21, further comprising selecting an adaptive codevector from an adaptive codebook, and selecting a pitch gain in combination with the mixed excitation function to represent the digitized speech.

* * * * *

UNITED STATES PATENT AND TRADEMARK OFFICE

CERTIFICATE OF CORRECTION

PATENT NO. : 6,073,092
DATED : June 6, 2000
INVENTOR(S) : Soon Y. Kwon

It is certified that error appears in the above-indentified patent and that said Letters Patent is hereby corrected as shown below:

In Claim 14, Column 23, Line 64;
after "signal", delete "outpt" and insert - - output- -.

Signed and Sealed this

Third Day of April, 2001

*Attest:*

Nicholas P. Godici

NICHOLAS P. GODICI

*Attesting Officer*

*Acting Director of the United States Patent and Trademark Office*